US006393995B1

(12) United States Patent
Mugnier

(10) Patent No.: US 6,393,995 B1
(45) Date of Patent: May 28, 2002

(54) APPARATUS AND METHOD FOR USE IN AERIAL ROPEWAYS

(75) Inventor: Jean-Francois Mugnier, Grand Junction, CO (US)

(73) Assignee: Poma of America, Inc., Grand Junction, CO (US)

( * ) Notice: Subject to any disclaimer, the term of this patent is extended or adjusted under 35 U.S.C. 154(b) by 0 days.

(21) Appl. No.: 09/609,730

(22) Filed: Jul. 3, 2000

(51) Int. Cl.[7] ..... B61B 9/00

(52) U.S. Cl. ..... 104/173.1; 104/89; 104/112; 104/180; 105/149.1; 105/149.2

(58) Field of Search ..... 104/89, 124, 112, 104/180, 182, 179, 204, 163, 168, 173.1, 115, 184, 178, 173.2, 233; 74/469; 212/226; 105/149.1, 149.2

(56) References Cited

U.S. PATENT DOCUMENTS

| | | | | | |
|---|---|---|---|---|---|
| 730,402 | A | * | 6/1903 | Riblet | 104/173.1 |
| 1,149,764 | A | | 8/1915 | Hinsen | |
| 2,228,391 | A | | 1/1941 | Hunziker | 104/180 |
| 2,714,356 | A | * | 8/1955 | Hunziker | 104/173.1 |
| 3,140,670 | A | * | 7/1964 | Renninger | 104/178 |
| 3,170,412 | A | * | 2/1965 | Sowder | 104/173.1 |
| 3,348,499 | A | * | 10/1967 | Sowder | 104/178 |
| 3,461,813 | A | * | 8/1969 | McIlvaine | 104/173.1 |
| 3,675,588 | A | * | 7/1972 | Gaynor | 104/173.1 |
| 3,931,766 | A | * | 1/1976 | Cathiard | 104/117 |
| 4,226,187 | A | | 10/1980 | Paulsen et al. | 104/182 |
| 4,329,926 | A | | 5/1982 | Sowder et al. | 104/179 |
| 4,462,314 | A | | 7/1984 | Kunczynski | 104/115 |
| 4,509,430 | A | * | 4/1985 | Creissels | 104/173.1 |
| 4,995,319 | A | * | 2/1991 | Mugnier | 104/112 |
| 5,081,932 | A | * | 1/1992 | Hofmann | 104/112 |
| 5,515,789 | A | * | 5/1996 | Brochand et al. | 104/184 |

* cited by examiner

*Primary Examiner*—S. Joseph Morano
*Assistant Examiner*—Lars A. Olson
(74) *Attorney, Agent, or Firm*—Klaas, Law, O'Meara & Malkin, P.C.; Joseph J. Kelly, Esq.

(57) ABSTRACT

An aerial ropeway wherein oppositely located first and second sheave trains are supported on a crossarm wherein first and second sheave train supporting apparatus are pivotally mounted at fixed spaced apart locations on the crossarm and the first and second sheave train supporting apparatus are each pivotally connected to an elongated member extending therebetween.

20 Claims, 5 Drawing Sheets

APPARATUS AND METHOD FOR USE IN AERIAL ROPEWAYS

FIELD OF THE INVENTION

This invention relates generally to aerial ropeways and the supporting of sheave trains used therewith and more specifically to the ensurement that the haul cables of the aerial ropeways remain in the sheave trains.

BACKGROUND OF THE INVENTION

A problem that exists in aerial ropeways is the chance of deropement wherein the haul cable or rope will separate from the sheave train. There are many reasons for deropement such as a vibration in the rope due to the power plant, the wind, an uneven load and others. There have been many attempts to prevent such deropements. Some of the devices have been successful but are very expensive or difficult to apply to existing installations. Others have not proven to be successful. This problem is particularly troublesome when the haul cables or ropes have to span a great distance which generally results in high rope lines, large changes in the haul cable or rope's slope, and large increases in the size of the haul cable or rope in addition to the above-mentioned problems. Therefore, there continues to exist a need for an efficient apparatus for preventing such deropement.

BRIEF DESCRIPTION OF THE INVENTION

This invention provides an articulated crossarm for an aerial ropeway so that the haul cable or rope will remain in the sheave train of the aerial ropeway. In a preferred embodiment of the invention, the aerial ropeway comprises an articulated crossarm which is supported by suitable apparatus at a desired location. The articulated crossarm has first sheave train supporting apparatus and first pivot apparatus for pivotally connecting the first sheave train supporting apparatus and the articulated crossarm and second sheave train supporting apparatus and second pivot apparatus for pivotally connecting the second sheave train supporting apparatus and the articulated crossarm. The first and second pivot apparatus are spaced apart a desired distance. A rigid elongated member or tie bar is provided and has opposite end portions. A third pivot apparatus pivotally connects one of the opposite end portions and the first sheave train supporting apparatus and a fourth pivot apparatus pivotally connects the other of the opposite end portions and the second sheave train supporting apparatus. In a preferred embodiment of the invention, the apparatus for supporting the articulated crossarm comprises first and second support towers fixedly mounted at spaced apart locations. At least two support cables spaced apart a predetermined distance are mounted on and extend between the first and second support towers. The ends of the support cables are securely fastened in fixed foundations. The articulated crossarm has opposite end sections each of which is secured to one of the at least two support cables.

The first and second sheave train supporting apparatus preferably comprise a first reaction arm mounted on the first pivot apparatus for pivotal movement. A first sheave train supporting apparatus is mounted on the first reaction arm and has a portion extending outwardly therefrom and a first sheave train is mounted on this outwardly extending portion. A second reaction arm is mounted on the second pivot apparatus for pivotal movement. A second sheave train supporting apparatus is mounted on the second reaction arm and has a portion extending outwardly therefrom. A second sheave train is mounted on this outwardly extending portion.

A continuous haul cable extends between at least two spaced apart rotatable pulleys and drive apparatus is provided for rotating at least one of the two spaced apart rotatable pulleys to move the continuous haul cable so that spaced apart portions of the continuous haul cable are located in the first and second sheave trains at all times. A plurality of carrying vehicles or gondolas are secured to the haul cable at spaced apart intervals for movement therewith and pass over the first and second sheave trains.

When the aerial ropeway is in a static or equilibrium position, the first, second, third and fourth pivot apparatus are located so that, when a line between the first and second pivot apparatus lies in a horizontal plane and another line between the third and fourth pivot apparatus is parallel to and spaced from the line, the first sheave train is directly below the first pivot apparatus and the second sheave train is directly below said second pivot apparatus. The lines between the first, second, third and fourth pivot apparatus preferably form a trapezoid wherein the distance between the first and second pivot apparatus is greater than the distance between the third and fourth pivot apparatus and the distance between the first and third pivot apparatus is substantially the same as the distance between the second and fourth pivot apparatus.

In some instances, the articulated crossarm of this invention is supported directly on the support cables. However, in other instances, the articulated crossarm is located a distance below the support cables so that super structure is added to the articulated crossarm and this superstructure is supported on the support cables. The articulated crossarm may also be mounted on the conventional towers of a conventional ski lift.

The following are explanations of the operation of the articulated crossarm of this invention when there is an uneven load, in that the carrying vehicles or gondolas secured to the haul cable on one side of the haul cable have a much heavier load than the carrying vehicles on the other side of the haul cable, and when the carrying vehicles or gondolas and the haul cable are subjected to a cross wind. In the event of an uneven load, the line between the first and second pivot apparatus would not lie in a horizontal plane so that the haul cable on the heavier side of the line would be below the horizontal plane and the haul cable on the lighter side of the line would be above the horizontal plane. If the crossarm was not articulated, the first and second sheave trains would be at an angle to the haul cable. However, with the articulated crossarm, the reaction arms and the tie bar have cooperated to position the first and second sheave trains so that the portions of the haul cable, having or not having a carrying vehicle or gondola located thereon, are located correctly in the first and second sheave trains. In the event of a cross wind, with or without an uneven load condition, a force tending to move the haul cable out of the correct position in the first and second sheave trains would be created. However, with the articulated crossarm, the reaction arms and the tie bar have cooperated to position the first and second sheave trains so that the portions of the haul cable, having or not having a carrying vehicle or gondola located thereon, are located correctly in the first and second sheave trains so that no force exists that would tend to move the haul cable out of the first and second sheave trains, exists.

BRIEF DESCRIPTION OF THE DRAWINGS

Preferred embodiments of the invention are illustrated in the drawings in which.

DETAILED DESCRIPTION OF THE INVENTION

Figure 1:
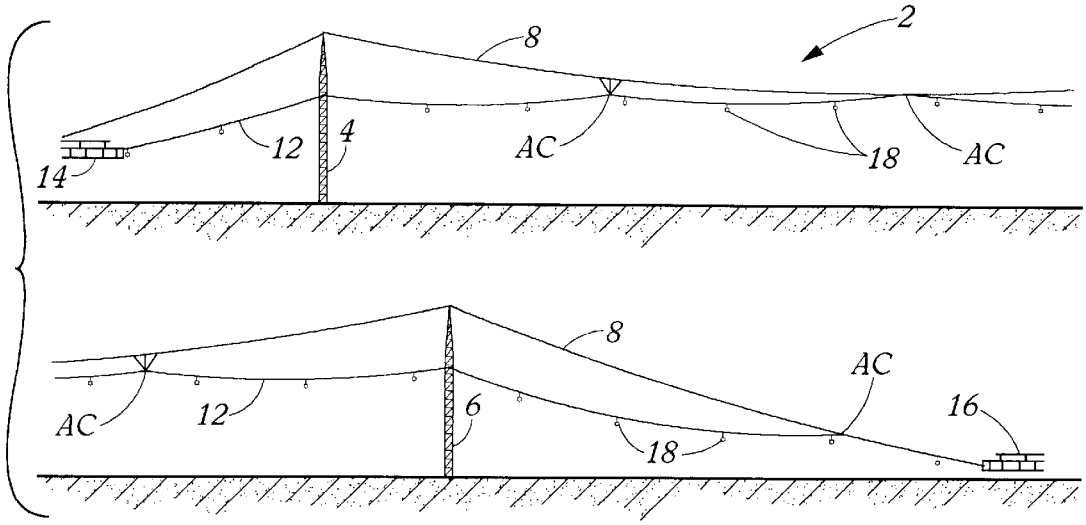
FIG. 1 is a schematic side elevational view illustrating two spaced apart towers holding supporting cables on which are supported articulated crossarms of this invention.
Figure 2:
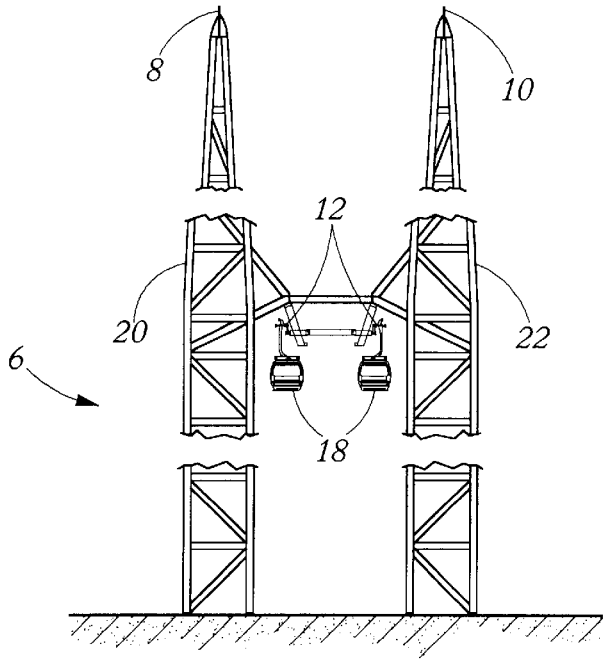
FIG. 2 is a schematic front elevational view illustrating one of the two towers.

In FIGS. 1 and 2, there is illustrated an aerial ropeway 2 of this invention. Two support towers 4 and 6 are securely mounted at locations spaced a considerable distance apart depending on the location. Two support cables 8 and 10 are supported on the two support towers 4 and 6 and the ends (not shown) of these support cables 8 and 10 are adjustably secured to fixed foundations. A continuous haul cable or rope 12 is passed around two rotatable pulleys 14 and 16 one or both of which are driven to move the haul cable 12. A plurality of carrying vehicles or gondolas 18 are mounted at spaced apart intervals on the haul cable 12 for movement therewith. The haul cable 12 and the gondolas 18 are supported on sheave trains, described more fully below, and pass over the sheave trains. As illustrated in FIG. 1, the sheave trains are supported on articulated crossarms AC of this invention, described more fully below. The support for the haul cable 12 and gondolas 18 between the portions 20 and 22 of the tower 6 can be an articulated crossarm of this invention or a conventional crossarm.

Figure 3:
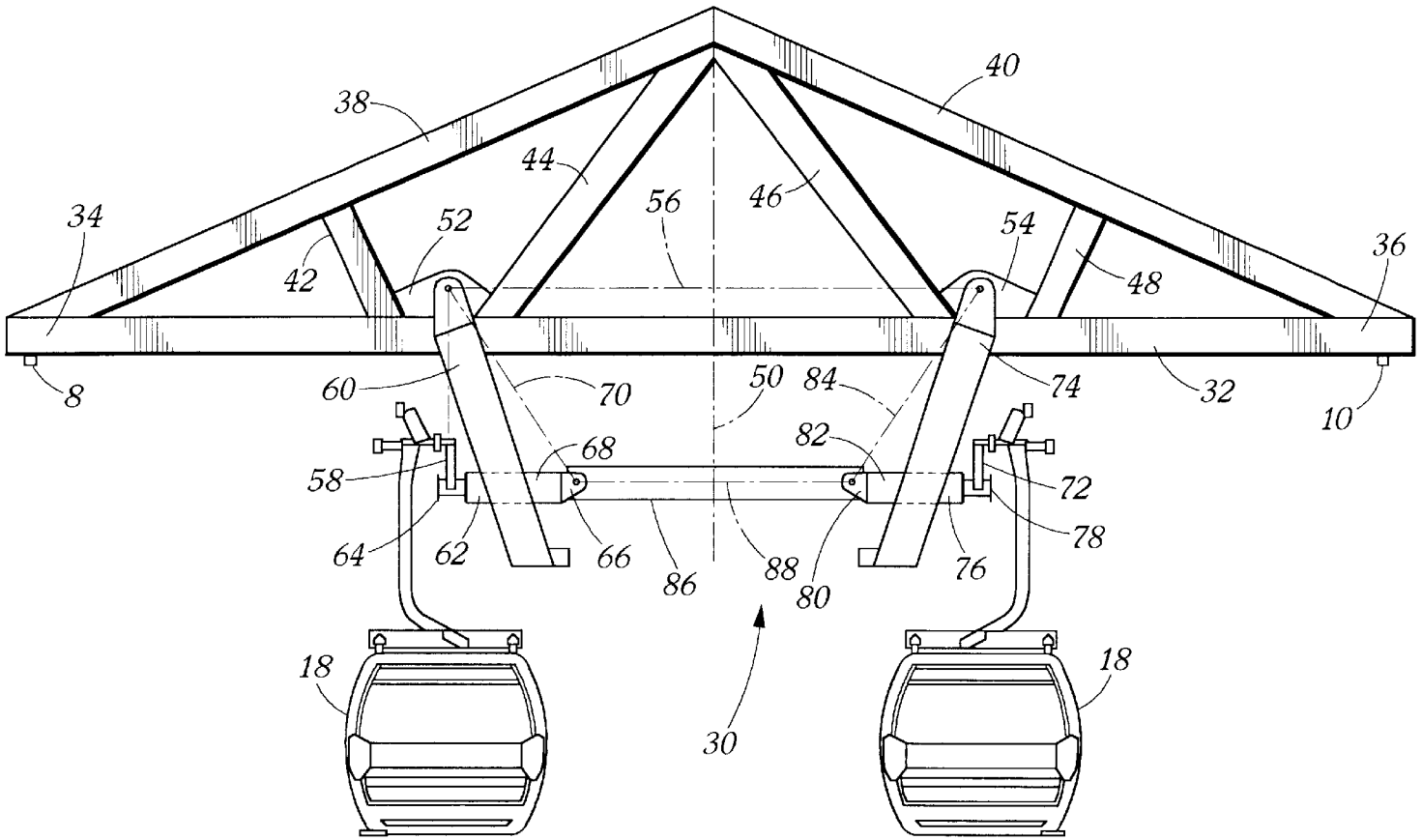
FIG. 3 is a schematic front elevational view illustrating preferred articulated crossarm of this invention in a static or equilibrium condition.

In FIG. 3, there is illustrated a preferred embodiment of an articulated crossarm 30 of this invention in a static or equilibrium condition. The articulated crossarm 30 has a main support member 32 having end portions 34 and 36. A portion of each of the support cables 8 and 10 is secured to each of the end portions 34 and 36. The main support member 32 is fixedly secured to a rigidifying structure comprising angularly related arms 38 and 40 and struts 42, 44, 46 and 48 and has a center line 50. A first pivot apparatus 52 is securely mounted at a fixed location on the main support member 32 and the struts 42 and 44. A second pivot apparatus 54 is securely mounted at a fixed location on the main support member 32 and the struts 46 and 48. As illustrated in FIG. 3, a line 56 extends between the pivotal axes of the first and second pivot apparatus 52 and 54. Apparatus for supporting a first sheave train 58 comprises a reaction arm 60 that is pivotally mounted on the first pivot apparatus 52 and has a transversely extending sheave train mounting member 62 securely mounted thereon. The first sheave train 58 is mounted on the portion 64 of the sheave train mounting member 62.

Figure 3A:
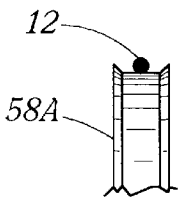
FIG. 3A is an enlarged portion of FIG. 3.

In FIG. 3*a*, there is illustrated an enlarged portion showing the preferred location of the haul cable 12 in one of pulleys 58A of a sheave train. This is the preferred relationship of the haul cable 12 in each of the pulleys of the sheave train wherein the haul cable 18 is centered in the pulleys.

As illustrated in FIG. 3, the first sheave train 58 is located directly below the pivotal axis of the first pivot apparatus 52. A third pivot apparatus 66 is mounted on the portion 68 of the sheave train mounting member 62 and a line 70 extends between the pivotal axes of the first and third pivot apparatus 52 and 66.

Apparatus for supporting a second sheave train 72 is also illustrated in FIG. 3 and comprises a reaction arm 74 pivotally mounted on the second pivot apparatus 54 and having a transversely extending sheave train mounting member 76 securely mounted thereon. The second sheave train 72 is mounted on the portion 78 of the sheave train mounting member 76. As illustrated in FIG. 3, the second sheave train 72 is located directly below the pivotal axis of the second pivot apparatus 54. A fourth pivot apparatus 80 is mounted on the portion 82 of the sheave train mounting member 76 and a line 84 extends between the pivotal axes of the second pivot apparatus 54 and the fourth pivot apparatus 80. An elongated member or tie bar 86 has one end portion pivotally connected to the third pivot apparatus 66 and the other end portion thereof pivotally connected to the fourth pivot apparatus, and a line 88 extends between the pivotal axes of the third pivot apparatus 66 and the fourth pivot apparatus 80.

In the preferred embodiment of the invention of the articulated crossarm 30, the lines 56, 70, 88 and 84 form a trapezoid when in a static or equilibrium condition. A line L1 extends between the pivotal axis of the first pivot apparatus 52 and the center of the pulleys of the first sheave train 58 and forms an angle of 90° with the main support member 32. Another line L2 extends between the pivotal axis of the second pivot apparatus 54 and the center of the pulleys of the second sheave train 72 and forms an angle of 90° with the main support member 32. The line 56 is longer in length than the line 88 and the lines 70 and 84 are of substantially the same length and are shorter in length than the line 88. It is recognized that in other embodiments of the invention the length of the lines 56, 70, 88 and 84 can be varied. In the static or equilibrium condition of FIG. 3, the line 56 lies in a plane that is substantially horizontal. The line 88 is parallel to the line 56 and is spaced therefrom. The lines 70 and 84 form acute angles with the line 56 and form obtuse angles with the line 88. While the gondolas 18 in FIG. 3 are illustrated as passing over the sheave trains 58 and 72 at the same time, this is not necessarily the preferred operating condition. In fact, under normal operating conditions, the gondolas 18 will not pass over the sheave trains 58 and 72 at the same time. It is further noted that, except for the articulated crossarm 30 and their association with the towers 6 and 8, the various components illustrated in the drawings are those normally associated with aerial ropeways and are commercially available. Also, the first, second, third and fourth pivot apparatus may be chosen from commercially available pivot apparatus. Also, conventional guy cables (not shown) which are parallel to the haul cable can be mounted on the reaction arms 60 and 72.

Figure 4:
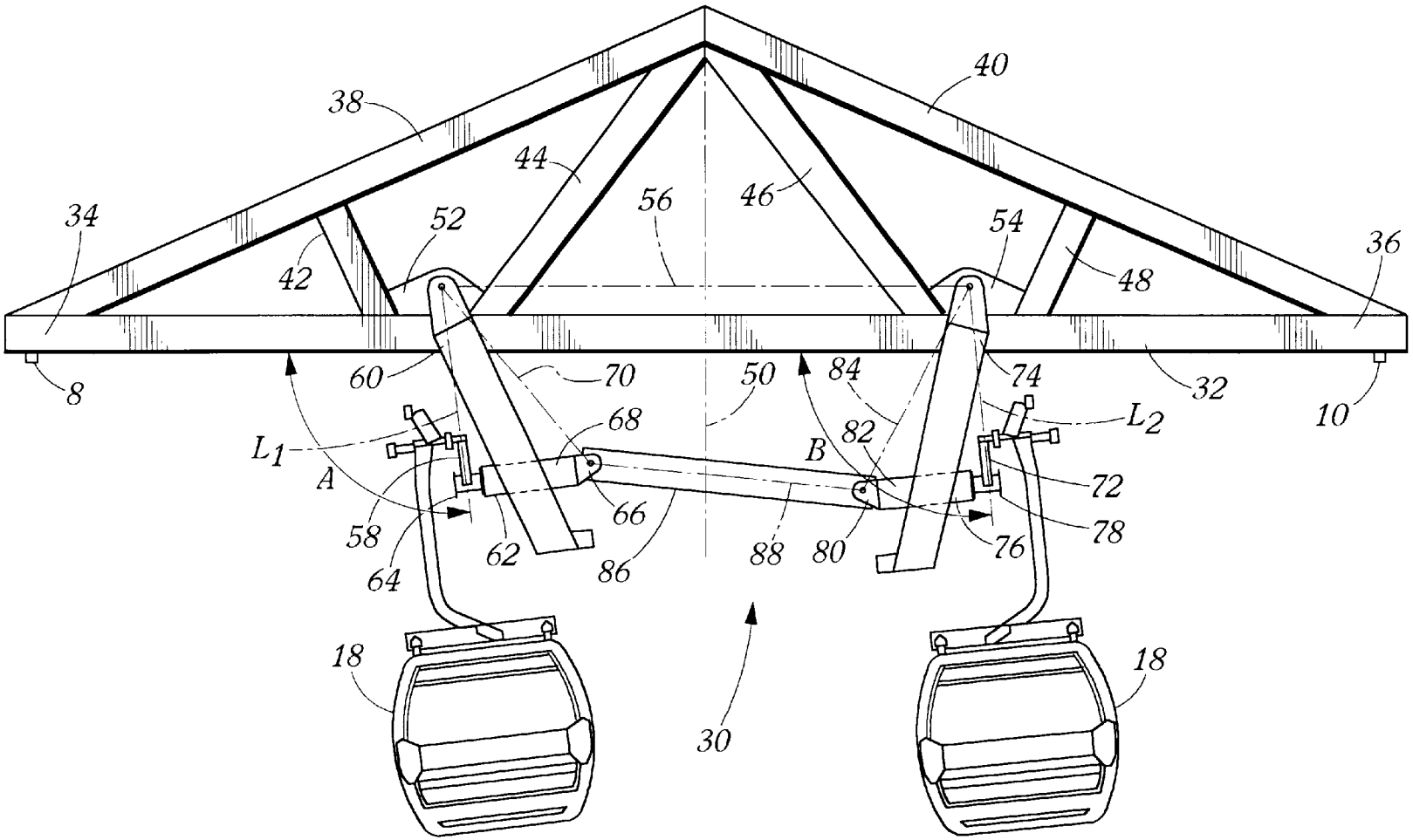
FIG. 4 is a schematic front elevational view illustrating the effect of a cross wind from the left on a preferred articulated crossarm of this invention.

The illustration in FIG. 4 depicts the reaction of the articulated crossarm 30 to a cross wind from the left of FIG. 4. The cross wind has applied a force to the haul cables 12 and the carrying vehicles or gondolas 18 and this force has pivotally moved the reaction arm 60 through the angle A and the reaction arm 74 through the angle B each of which are greater than 90°. The angles A and B do not have to be of the same degrees. The pivotal movements of the reaction arms 60 and 74 have also moved the sheave train mounting apparatus 62 and 76 and the sheave trains 58 and 72 through the same angle. The elongated member or tie bar 86 functions to keep the reaction arms 60 and 74 spaced apart and cooperates to control the pivotal movement of the reaction arms 60 and 72. The pivotal movement of the reaction arms 60 and 72, the sheave train mounting apparatus 62 and 76 and the sheave trains 58 and 72 function to keep the haul cable 12 centered in the pulleys of the sheave trains 58 and 72 as illustrated in FIG. 3*a*.

Figure 5:
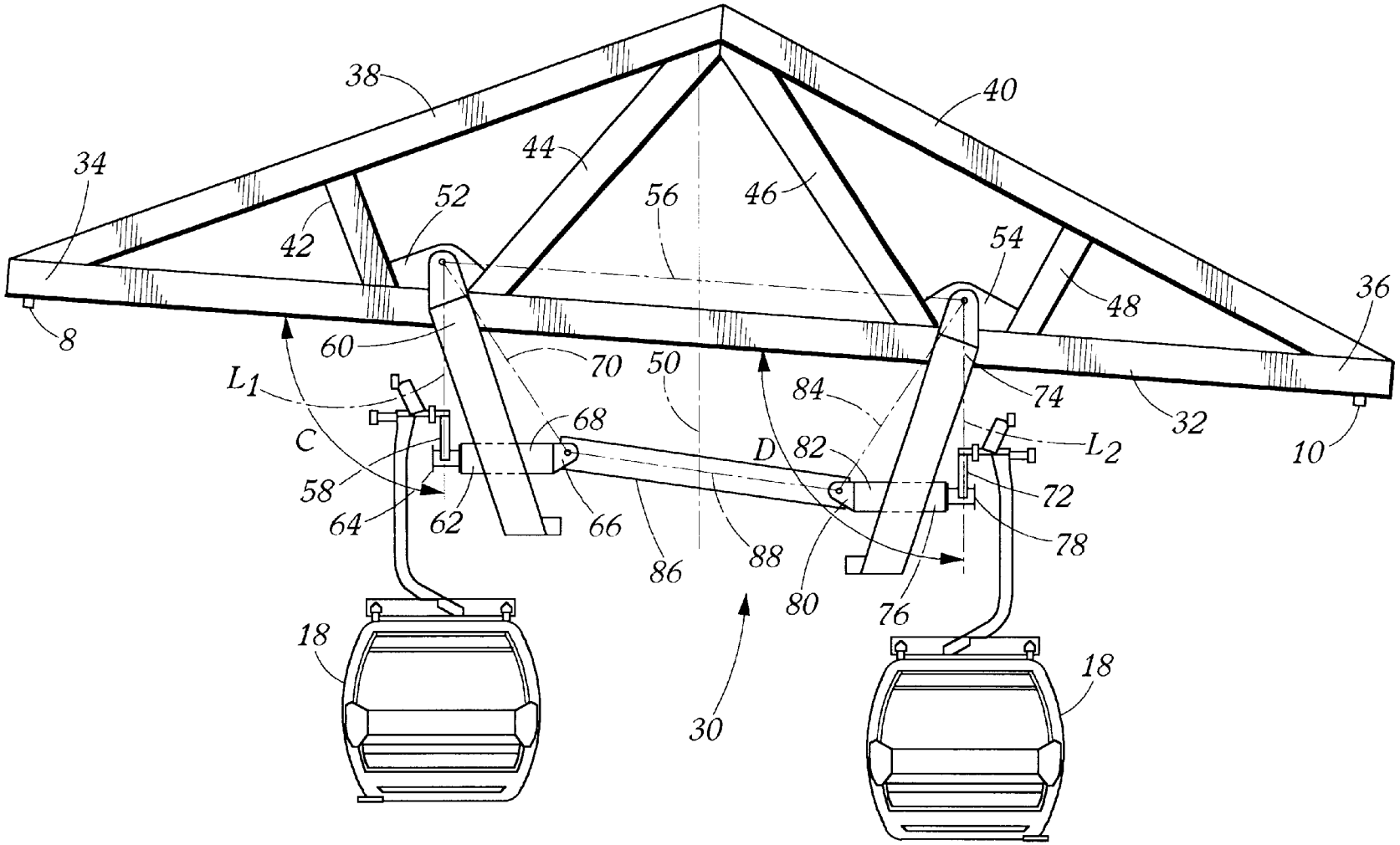
FIG. 5 is a schematic front elevational view illustrating the effect of an uneven load on a preferred articulated crossarm of this invention.

The illustration in FIG. 5 depicts the reaction of the articulated crossarm 30 when there is an uneven load which, as illustrated in FIG. 5, the load on the support cable 10 is much greater than the load on the support cable 8 so that the main support member 32 has moved out of the horizontal plane and is now at an angle to the horizontal plane. The reaction arms 60 and 74 have responded to the uneven load and have moved through the angles C and D, each of which is greater than the original relationship in the static or equilibrium condition of 90°. The angles C and D do not have to be of the same degrees. The pivotal movements of the reaction arms 60 and 74 have also moved the sheave train mounting apparatus 62 and 76 and the sheave trains 58 and 72 through the corresponding same angles. The elongated member or tie bar 86 functions to keep the reaction arms 60 and 74 spaced apart and cooperates to control the pivotal movement of the reaction arms 60 and 74. The pivotal movement of the reaction arms 60 and 74, the sheave train mounting apparatus 62 and 76 and the sheave trains 58 and 72 function to keep the haul cable 12 centered in the pulleys of the sheave trains 58 and 72 as illustrated in FIG. 3*a*.

Figure 6:
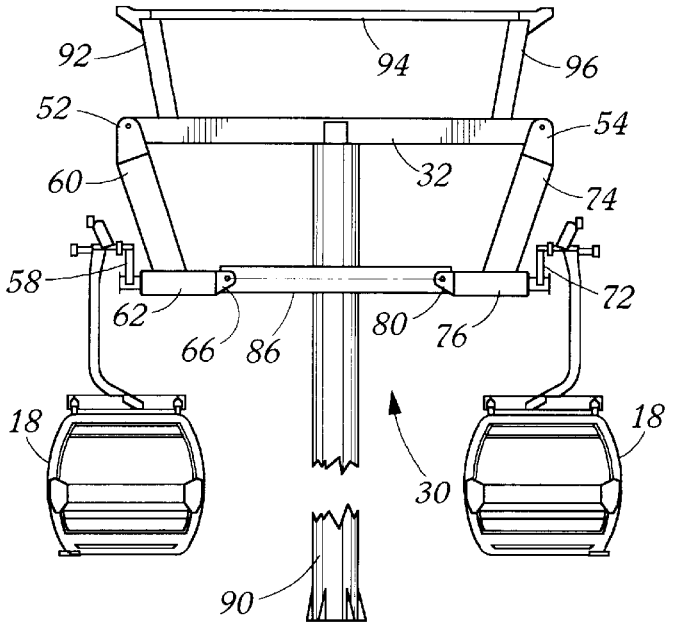
FIG. 6 is a schematic front elevational view illustrating the use of a preferred articulated crossarm of this invention on a conventional ski lift tower.

In FIG. 6, there is illustrated an articulated crossarm 30 of this invention mounted on the tower 90 of a conventional ski lift. Some of the reference numerals used in FIGS. 3–5 are used to identify corresponding parts in FIG. 6 and will not be further explained. The elongated member or tie bar 86 can be of various constructions to accommodate the tower 90. The structures of FIG. 6 and the functions thereof correspond to the structures and functions described above in relation to FIGS. 3–5. The superstructure comprising the members 92, 94 and 96 are for strength contributing purposes.

Figure 7:
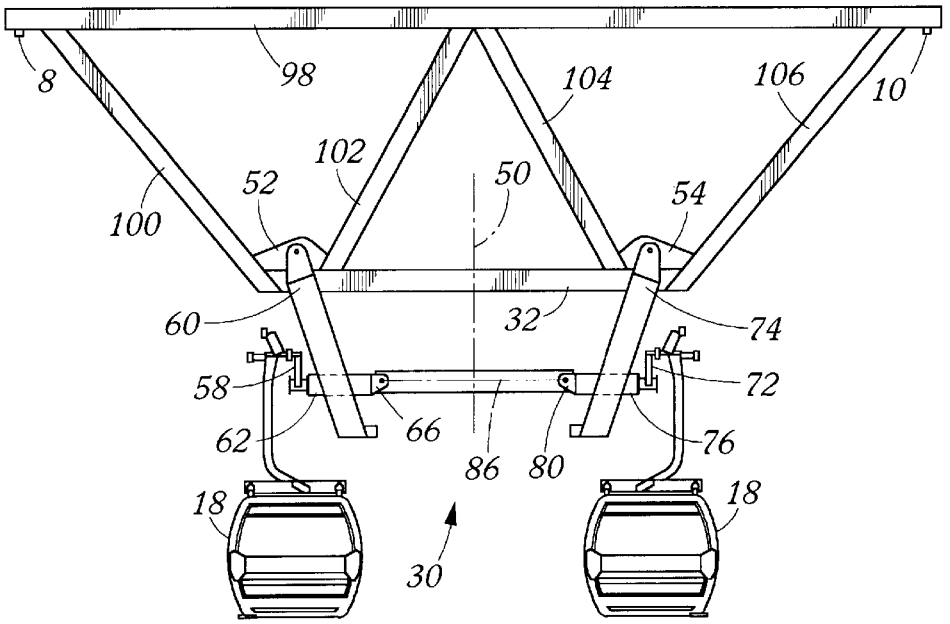
FIG. 7 is a schematic front elevational view illustrating a preferred articulated crossarm of this invention having superstructure which is mounted on the support cables.

In FIG. 7, there is illustrated an articulated crossarm 30 of this invention wherein the support cables 8 and 10 are spaced a greater distance from the main support member 32. Some of the reference numerals used in FIG. 3–5 are used to identify corresponding parts in FIG. 7 and will not be further explained. The members 98, 100, 102, 104 and 106 are provided to locate the main support member 32 at the desired location. The structures of FIG. 7 and the functions thereof correspond to the structures and functions described above in relation to FIGS. 3–5.

In accordance with the above description, a method for supporting oppositely located first and second sheave trains for an aerial ropeway comprises: supporting a crossarm; pivotally connecting first sheave train supporting apparatus at a first fixed location on the crossarm; pivotally connecting second sheave train supporting apparatus at a second fixed location on the crossarm and spaced from the first fixed location using a second pivot apparatus; pivotally connecting one end portion of an elongated member to the first sheave train supporting apparatus using a third pivot apparatus; and pivotally connecting another end portion of the elongated member to the second sheave train supporting apparatus using a fourth pivot apparatus. The method further comprises locating the first, second, third and fourth pivot apparatus so that lines between the first, second, third and fourth pivot apparatus when in a static or equilibrium condition form a trapezoid; locating the first, second, third and fourth pivot apparatus so that the distance between the first and second pivot apparatus is greater than the distance between the third and fourth pivot apparatus; and locating the first, second, third and fourth pivot apparatus so that the distance between the first and third pivot apparatus is substantially the same as the distance between the second and fourth pivot apparatus.

It is contemplated that the inventive concepts herein described may be variously otherwise embodied and it is intended that the appended claims be construed to include alternative embodiments of the invention except insofar as limited by the prior art.

What is claimed is:

1. Apparatus for supporting oppositely located sheave trains of an aerial ropeway comprising:

a crossarm having a center portion and opposite side portions;

apparatus for supporting said crossarm;

first sheave train supporting apparatus;

first pivot apparatus located on one of said opposite side portions for pivotally connecting said first sheave train supporting apparatus and said crossarm;

second sheave train supporting apparatus;

second pivot apparatus located on the other of said opposite side portions for pivotally connecting said second sheave train supporting apparatus and said crossarm;

said first and second pivot apparatus being spaced apart a desired distance;

a rigid elongated member having opposite end portions;

third pivot apparatus for pivotally connecting one of said opposite end portions and said first sheave train supporting apparatus; and fourth pivot apparatus for pivotally connecting the other of said opposite end portions and said second sheave train supporting apparatus.

2. Apparatus as in claim 1 wherein said apparatus for supporting said crossarm comprises:

first and second support towers fixedly mounted at spaced apart locations;

at least two support cables spaced apart a predetermined distance and mounted on and extending between said first and second support towers;

said crossarm having opposite end sections;

first securing apparatus for securing one of said opposite end sections to one of said at least two support cables; and second securing apparatus for securing the other of said opposite end sections to the other of said at least two support cables.

3. Apparatus as in claim 2 wherein said first and second sheave train supporting apparatus comprise:

a first reaction arm mounted on said first pivot apparatus for pivotal movement;

first support apparatus mounted on said first reaction arm and having a portion extending outwardly from said first reaction arm;

a first sheave train mounted on said portion of said first reaction arm;

a second reaction arm mounted on said second pivot apparatus for pivotal movement;

second support apparatus mounted on said second reaction arm and having a portion extending outwardly from said second reaction arm; and a second sheave train mounted on said portion of said second reaction arm.

4. Apparatus as in claim 3 and further comprising:

a continuous haul cable extending between at least two spaced apart rotatable pulleys;

drive apparatus for rotating at least one of said two spaced apart rotatable pulleys to move said continuous haul cable; and spaced apart portions of said continuous haul cable being located in said first and second sheave trains.

5. Apparatus as in claim 4 and further comprising:

a plurality of gondolas secured to said haul cable at spaced apart intervals.

6. Apparatus as in claim 1 wherein said first and second sheave train supporting apparatus comprise:

a first reaction arm mounted on said first pivot apparatus for pivotal movement;

first support apparatus mounted on said first reaction arm and having a portion extending outwardly from said first reaction arm;

a first sheave train mounted on said portion of said first reaction arm;

a second reaction arm mounted on said second pivot apparatus for pivotal movement;

second support apparatus mounted on said second reaction arm and having a portion extending outwardly from said second reaction arm; and a second sheave train mounted on said portion of said second reaction arm.

7. Apparatus as in claim 6 and further comprising:

a continuous haul cable extending between at least two spaced apart rotatable pulleys;

drive apparatus for rotating at least one of said two spaced apart rotatable pulleys to move said continuous haul cable; and spaced apart portions of said continuous haul cable being located in said first and second sheave trains.

8. Apparatus as in claim 7 and further comprising:

a plurality of gondolas secured to said haul cable at spaced apart intervals.

9. Apparatus as in claim 1 wherein:

said first, second, third and fourth pivot apparatus are located, when in a static or equilibrium condition, so that, when a line between said first and second pivot apparatus lies in a horizontal plane and another line between said third and fourth pivot apparatus is parallel to and spaced from said line, said first sheave train is directly below said first pivot apparatus and said second sheave train is directly below said second pivot apparatus.

10. Apparatus as in claim 9 wherein:

lines between said first, second, third and fourth pivot apparatus form a trapezoid.

11. Apparatus as in claim 10 wherein:

the distance between said first and second pivot apparatus is greater than the distance between said third and fourth pivot apparatus.

12. Apparatus as in claim 11 wherein:

the distance between said first and third pivot apparatus is substantially the same as the distance between said second and fourth pivot apparatus.

13. Apparatus as in claim 12 wherein said apparatus for supporting said crossarm comprises:

first and second support towers fixedly mounted at spaced apart locations;

at least two support cables spaced apart a predetermined distance and mounted on and extending between said first and second support towers;

said crossarm having opposite end sections;

first securing apparatus for securing one of said opposite end sections to one of said at least two support cables; and second securing apparatus for securing the other of said opposite end sections to the other of said at least two support cables.

14. Apparatus as in claim 13 wherein said first and second sheave train supporting apparatus comprise:

a first reaction arm mounted on said first pivot apparatus for pivotal movement;

first support apparatus mounted on said first reaction arm and having a portion extending outwardly from said first reaction arm;

a first sheave train mounted on said portion of said first reaction arm;

a second reaction arm mounted on said second pivot apparatus for pivotal movement;

second support apparatus mounted on said second reaction arm and having a portion extending outwardly from said second reaction arm; and a second sheave train mounted on said portion of said second reaction arm.

15. Apparatus as in claim 14 and further comprising:

a continuous haul cable extending between at least two spaced apart rotatable pulleys;

drive apparatus for rotating at least one of said two spaced apart rotatable pulleys to move said continuous haul cable; and spaced apart portions of said continuous haul cable being located in said first and second sheave trains; and a plurality of gondolas secured to said haul cable at spaced apart intervals.

16. A method for supporting oppositely located sheave trains of an aerial ropeway comprising:

supporting a crossarm having a center portion and opposite side portions;

pivotally connecting first sheave train supporting apparatus at a first fixed location on one of said opposite side portions of said crossarm using a first pivot apparatus;

pivotally connecting second sheave train supporting apparatus at a second fixed location on the other of said opposite side portions of said crossarm spaced from said first fixed location using a second pivot apparatus;

pivotally connecting one end portion of an elongated member to said first sheave train supporting apparatus using a third pivot apparatus; and pivotally connecting another end portion of said elongated member to said second sheave train supporting apparatus using a fourth pivot apparatus.

17. A method as in claim 16 wherein:

locating said first, second, third and fourth pivot apparatus so that, when in a static or equilibrium condition, lines between said first, second, third and fourth pivot apparatus form a trapezoid.

18. A method as in claim 17 and further comprising:

locating said first, second, third and fourth pivot apparatus so that the distance between said first and second pivot apparatus is greater than the distance between said third and fourth pivot apparatus.

19. A method as in claim 18 and further comprising:

locating said first, second, third and fourth pivot apparatus so that the distance between said first and third pivot apparatus is substantially the same as the distance between said second and fourth pivot apparatus.

20. Apparatus for controlling the sag in at least one moving haul cable of an aerial ropeway comprising:

at least first and second support towers fixedly mounted a predetermined distance apart;

at least two support cables spaced a predetermined distance apart and mounted on and extending between said first and second support towers;

at least one crossarm having a first and second sheave train supporting apparatus mounted thereon and located between said at least first and second support towers;

at least one moving haul cable passing through said first sheave train supporting apparatus in one direction and said at least one moving haul cable passing through said second sheave train supporting apparatus in the opposite direction;

said at least one crossarm having opposite end sections;

first securing apparatus for securing one of said opposite end sections to one of said at least two support cables; and second securing apparatus for securing the other of said opposite end sections to the other of said at least two support cables.

* * * * *